US005791416A

United States Patent [19]

White et al.

[11] Patent Number: 5,791,416

[45] Date of Patent: Aug. 11, 1998

[54] WELL COMPLETION DEVICE AND METHOD OF CEMENTING

[76] Inventors: Kenneth M. White, 2432 Paliswood Rd. SW., Calgary, Alberta, Canada, T2V 3P8; Stephen Bruce Mitchell, 1500 How Valley Square 4, 250 6th Ave. SW., Calgary, Alberta, Canada, T2P 387

[21] Appl. No.: 679,674

[22] Filed: Jul. 12, 1996

[51] Int. Cl.[6] ..... E21B 33/14

[52] U.S. Cl. ..... 166/285; 166/177.4

[58] Field of Search ..... 166/177.4, 180, 166/242.1, 285, 326, 327

[56] References Cited

U.S. PATENT DOCUMENTS

| | | | |
|---|---|---|---|
| Re. 30,711 | 8/1981 | Suman, Jr. | 166/285 |
| 1,959,368 | 5/1934 | Kennedye | 166/285 |
| 3,918,522 | 11/1975 | Suman, Jr. | 166/187 X |
| 4,495,997 | 1/1985 | Scott et al. | 166/285 |
| 4,913,232 | 4/1990 | Cheymol et al. | 166/285 |
| 5,327,962 | 7/1994 | Head | 166/187 |

FOREIGN PATENT DOCUMENTS

| | | | |
|---|---|---|---|
| 1095830 | 2/1981 | Canada . | |
| 1208537 | 7/1986 | Canada . | |
| 1435759 | 11/1988 | U.S.S.R. | 166/285 |
| 91/19882 | 12/1991 | WIPO | 166/285 |

*Primary Examiner*—David J. Bagnell

*Attorney, Agent, or Firm*—Antonelli, Terry, Stout & Kraus, LLP

[57] ABSTRACT

A method of cementing a production casing in a borehole having a surface casing therein wherein cement is pumped down through the production casing thereby cementing the production casing into the borehole and the surface casing. Prior to pumping a special production casing section carrying a tubular expandable resilient bladder is installed in the production casing. The bladder has flanges at either end and slots passing through the flanges. The bladder has an internal thread at one end which mates with an external thread on the casing section thereby anchoring the bladder. The other end of the bladder is free. When installed there is clearance between the bladder and the surrounding surface casing. This permits the bladder to expand upwardly when cement is pumped through and when there is a sufficient head of cement after pumping the bladder collapses and provides a good seal between the production casing section and the surface casing section.

16 Claims, 7 Drawing Sheets

WELL COMPLETION DEVICE AND METHOD OF CEMENTING

BACKGROUND OF THE INVENTION

This invention relates to the oil and gas well drilling industry and more specifically to the completion operations for oil and gas production wells.

It is common practice during drilling and completion of these wells to cement casing Into the well bore to prevent contamination of surface ground water and various non-productive zones from fluids used during drilling and later production of the well.

Typically a gas or oil well is formed by drilling down 40–100 ft, placing a surface casing in the borehole and cementing the surface casing to the surrounding ground. Thereafter a smaller drill bit is attached to the drill string which is passed down the cemented surface casing to drill the borehole proper down to the oil or gas reservoirs. A production casing several inches narrower in diameter than the surface casing is then passed down through the surface casing to line the borehole down to the oil or gas reservoir. At the top the production casing extends concentrically with the surface casing. Cementing of the production casing to the surrounding ground formation and of the production casing to the surface casing Is then carried out by pumping cement and then water down through the production casing and back up on the outside of the production casing and through the annular gap between the production casing and the surface casing.

In certain wells, despite the common practice of utilizing conventional cementing procedures, it has been observed that there is gas or fluid leakage after the cement has set and the well is completed. This condition leads to surface or ground water contamination or in some cases the escape of hydrogen sulphide or natural gas to the atmosphere. The resulting problems are very expensive to correct.

The causes of the leakage due to physical conditions can be attributed to poor bonding of the cement to the formation due to drilling fluid contamination or bonding of the cement to the casing after the cement has set and/or oil or mill finish contamination on the surface of the casing. A more fundamental cause is the loss of hydrostatic head during the curing of the cement such that the formation pressure exceeds the annulus pressure and gas migration occurs causing channelling of the cement and subsequent leakage. Various additives and application techniques have been tried relative to the cement being used in order to reduce the occurrence of this problem. Compressible cement slurries have additives that entrain gas which during the pumping operation is compressed and as the hydrostatic head is lost during curing of the cement subsequently expand and prevent loss of the pore pressure such that formation gas is prevented from migrating into the annulus. This technique results in a lower strength cement. Thixotropic cement slurries depend on the cement achieving high gel strengths in very short time periods. It there is a rapid static gel strength obtained gas migration and channelling are reduced or prevented. These specialized cement additives are expensive and require specific operational techniques.

SUMMARY OF THE INVENTION

It is an objective of this invention to provide a method of preventing gas and fluid leakage in well bores by a relatively inexpensive mechanical means that do not require specialized cements or operational techniques. This is accomplished by providing during installation of the production casing one or more resilient bladders that stretch and allow cement to flow through them as cement is pumped and subsequently contract when the pumping ceases and the cement Is allowed to cure. These bladders can be installed typically in specific locations between the production casing and the surface casing to isolate known high pressure gas zones or above and below zones that will be perforated for oil or gas production but they can be installed anywhere on the production casing string. Installation is achieved by attaching the lower end of the bladder to a piece of production casing pipe.

DETAILED DESCRIPTION OF PREFERRED EMBODIMENTS

Figure 1:
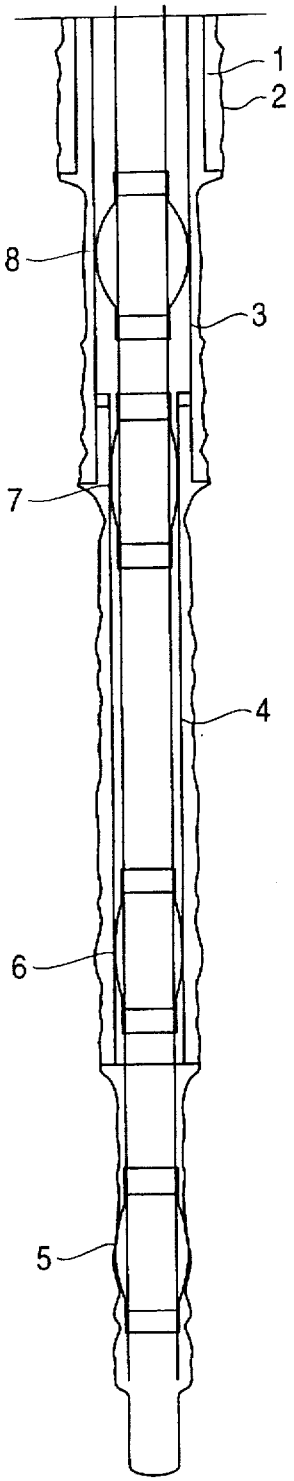
FIG. 1 is a schematic elevation showing in longitudinal section a typical well bore having surface and production casing installed.

The well bore shown in FIG. 1 has conductor casing 1 cemented in place at 2 and surface casing 3 cemented to surface. Intermediate or production casing is cemented to surface. The production liner 4 is suspended and cemented full length. Centralizers shown at 5, 6, 7, 8, are uniformly spaced along all casings to provide for concentricity of the casings in the well bore.

Figure 2:
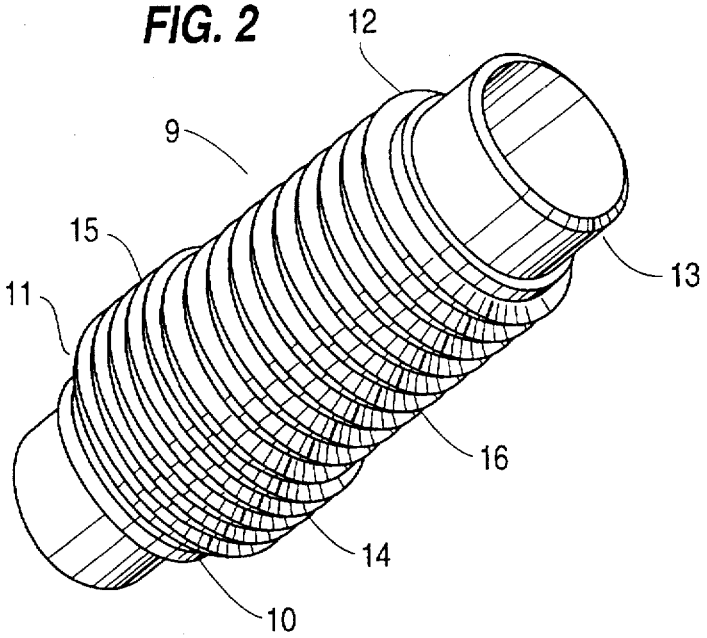
FIG. 2 is a perspective view of a bladder according to the invention installed in a casing section.

The bladder assembly 9 shown in FIG. 2 is formed from an elastomeric material, e.g., urethane, and is tubular in nature. Attachment means 10 is integrally bonded at the lower end 11. The upper end 12 is free to move along a production casing section 13. Flow restriction is provided at 14 in the form of a series of annular rings 15 such that during installation deformation occurs and a seal is effected between the bore of a previously installed casing or the well bore. The intermediate area of the bladder 9 is formed as a bellows 16 such that under internal pressure a change in the longitudinal length of the assembly occurs.

Figure 2A:
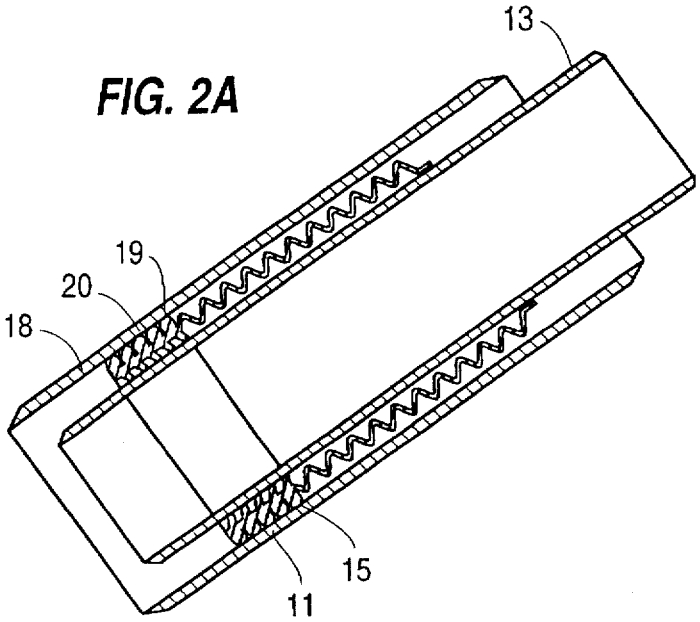
FIG. 2A is a longitudinal sectional view showing the bladder and casing section of FIG. 2 in position.

FIG. 2A shows the longitudinal section of bladder assembly 9. Production casing section 13 is shown received in surface casing section 18 as in working operation. Lower end 11 has flow restriction rings 15 deformed by surface casing 18 to effect a seal at that point. Valving 19 at lower end 11 internal to attachment means 10 consists of a series of annular rings 20 angled in the flow direction of the cement.

Figure 3:
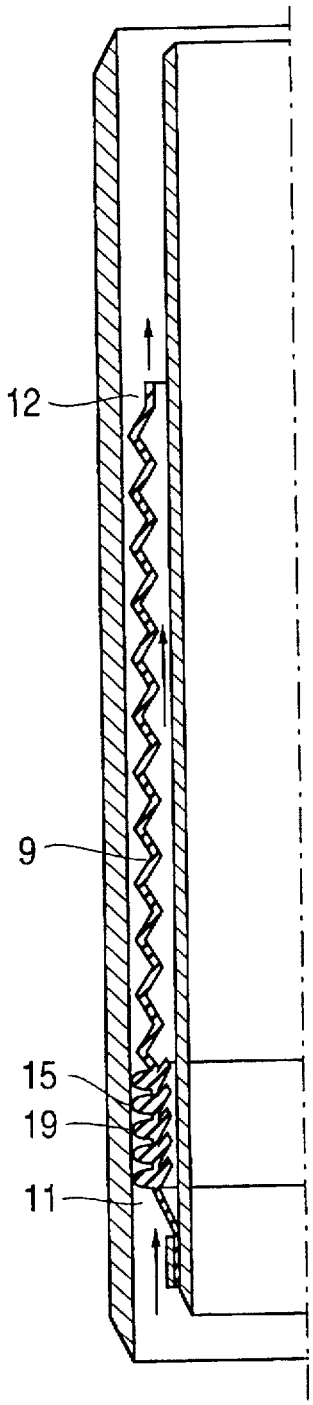
FIG. 3 is a view similar to FIG. 2A but drawn to a larger scale and showing the bladder during the cementing operation.

FIG. 3 illustrates the bladder assembly 9 viewed in section during a cementing operation. Valving 19 is open due to the pressure differential between the lower end 11 and upper end 12. The resistance to flow of the cement due to the restriction at upper end 12 causes the bladder to extend from its at rest position. During cementing operations it is common to both reciprocate and rotate the casing during the pumping operation to break-up or close any cement channels around centralizers or other down hole assemblies. The flow restriction rings 15 slide on the previously installed casing or well bore and the bladder remains extended during these operations.

Figure 4:
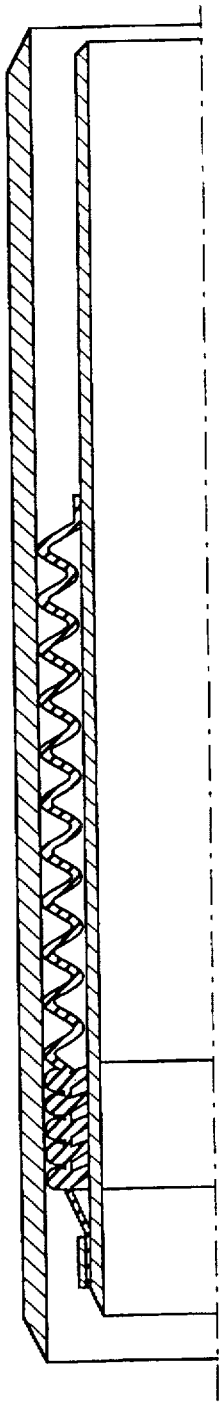
FIG. 4 is a view similar to FIG. 3 but showing the bladder during the curing process.

Once the pumping of the cement is complete there is no pressure differential across the bladder and due to the natural elasticity of the rubber the bladder assumes the position illustrated in FIG. 4. Valving at 19 closes to restrict reverse flow of the cement and upper end 12 contracts towards inner casing 13. A portion of the cement will be retained within the bladder and this cement will be forced against the casing effecting a superior bond between the cement and the casing. If the pumping pressure is relaxed the closing of the upper end 12 causes the full hydrostatic head of the cement column to be exerted on the bladder further compressing the bellows section 16.

Figure 5:
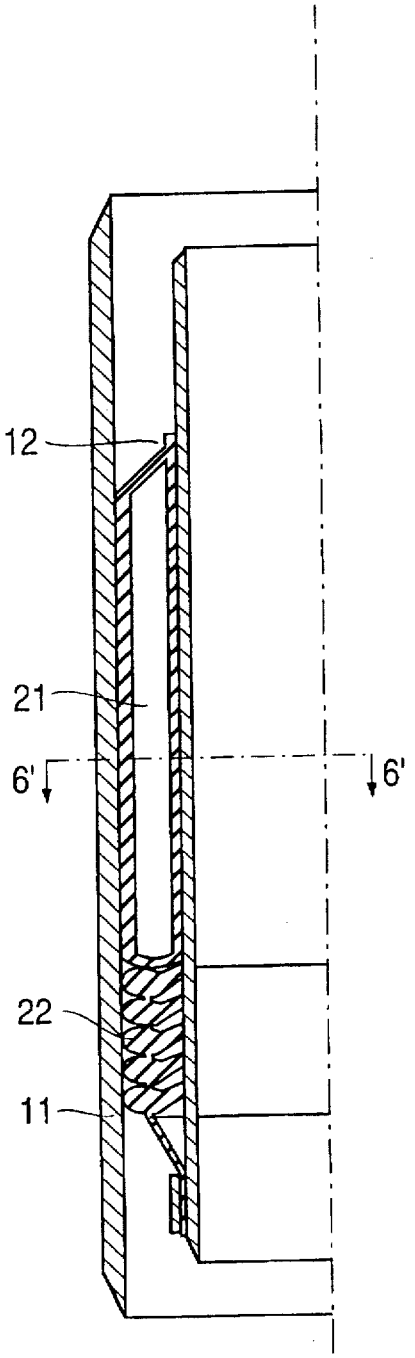
FIG. 5 is a longitudinal sectional view illustrating an alternate configuration of bladder in position.

The alternate configuration of bladder assembly shown in FIG. 5 is intended for radial expansion of the bellows section 21. Similar features to those previously disclosed are used at lower end 11 and upper end 12. The annular sealing rings 22 In this configuration would allow for a greater amount of radial compression such that a larger range of outer casing or well bore sizes could be accommodated with this type of bladder assembly.

Figure 6:
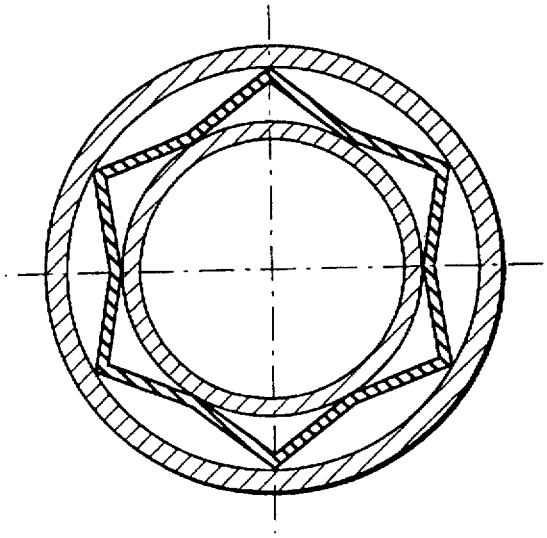
FIG. 6 is a cross sectional view along line 6'—6' of FIG. 5.

The cross section shown in FIG. 6 illustrates generally the relaxed configuration of a bladder assembly according to FIG. 5 at line A—A. The bladder assembly shown in FIG. 5 and 6 does not exhibit a significant change in longitudinal length during cement pumping operations, radial expansion is the primary mode of change.

Figure 9:
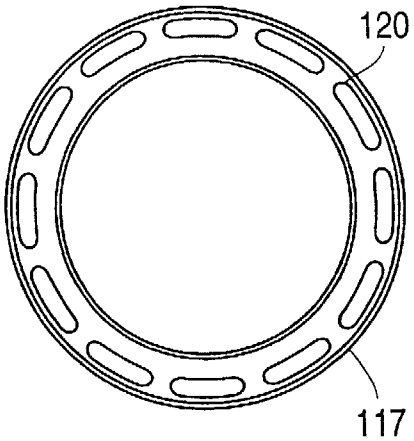
FIG. 9 is a view of the right hand of the bladder shown in FIG. 7.
Figure 7:
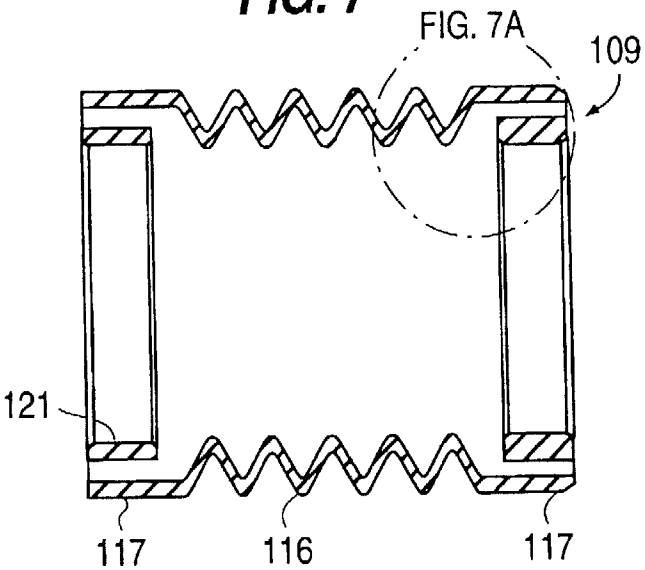
FIG. 7 is a longitudinal section to an enlarged scale of a preferred form of bladder according to the invention.
Figure 7A:
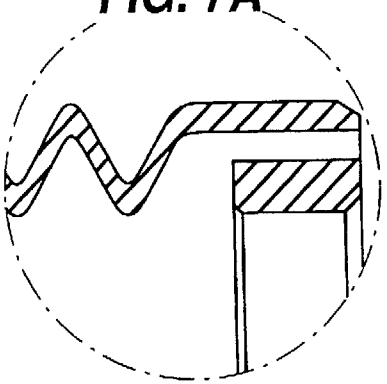
FIG. 7A is an enlarged view of a detail indicated by the letter A in FIG. 7.
Figure 8:
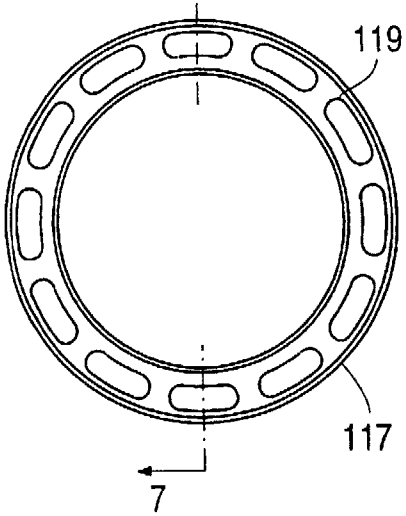
FIG. 8 is a view of the left hand of the bladder shown in FIG. 7.

Referring now to FIGS. 7, 8 and 9 which show a preferred form of the bladder 109, the bladder is generally concertina-shaped, having a tubular bellows 116 located between two flanges 117. Both flanges are provided with circumferentially disposed slots which extend longitudinally from the exterior of the bladder 109 to the interior of the bellows with the slots 119 in the left hand flange being considerably greater In cross-sectional order than the slots 120 in the right hand flange. The slots 119 and 120 taper slightly in a direction towards the interior of the bladder 109.

Figure 10:
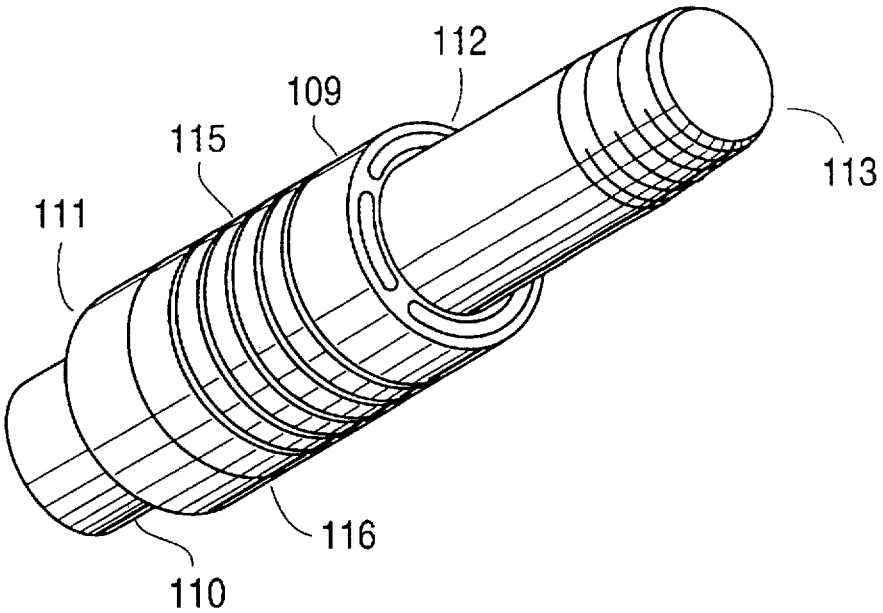
FIG. 10 is a view similar to FIG. 2 in which the preferred bladder of FIG. 7 is used.

The bore of each flange is substantially identical in diameter but, whereas the right hand flange is intended to be received slidably on a casing section, the left hand flange is intended to be secured to the casing section and for that purpose the bore of the left hand flange Is provided with an internal thread 121. FIG. 10 shows the bladder 109 mounted on a production casing section 113 by virtue of the internal thread 121 of the bladder being mated with an external thread provided at point 111 at the lower end of the casing section 113. The bladder is preferably also bonded to the casing section 113 at that point.

Figure 10A:
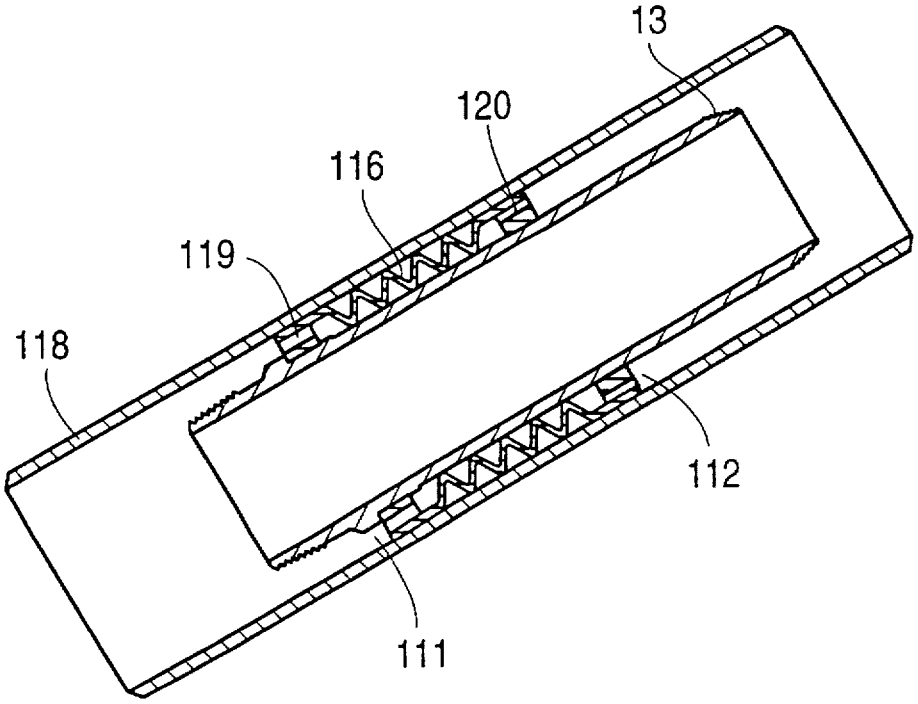
FIG. 10A is a longitudinal sectional view showing the bladder and casing section of FIG. 10 in position.
Figure 11:
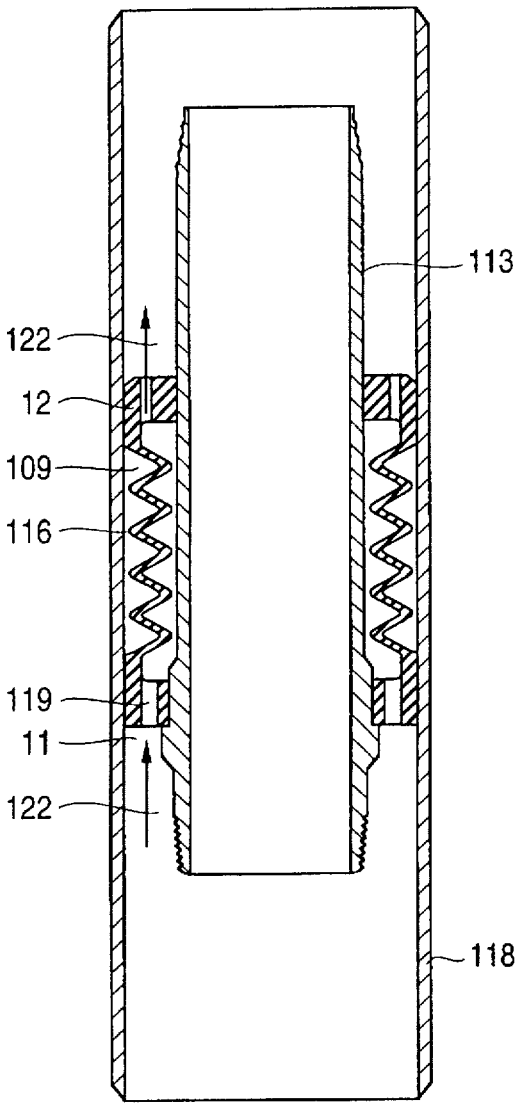
FIG. 11 is a view similar to FIG. 10A but drawn to a larger scale and showing the bladder during the cementing operation.

Referring now to FIG. 10A, this shows the assembly of FIG. 2 installed inside a surface casing section 118. It can be seen from FIG. 11 that there Is a small clearance between the outside of the bladder 119 and the inside surface of the surface casing section 11B. During a cementing operation, as illustrated In FIG. 11, the slots 119 permit cement and fluid to flow upwardly as indicated by the arrows 122 due to the pressure differential between the lower end 111 and the upper end 112. Because of the small cross-section of the slots 120 this provides a resistance to flow of the cement which causes the bellows 116 to extend from its rest position to an extended position, the upper flange 117 sliding on the casing section 119. Cement also flows up through the clearance and over the outside of the bladder 109.

Figure 12:
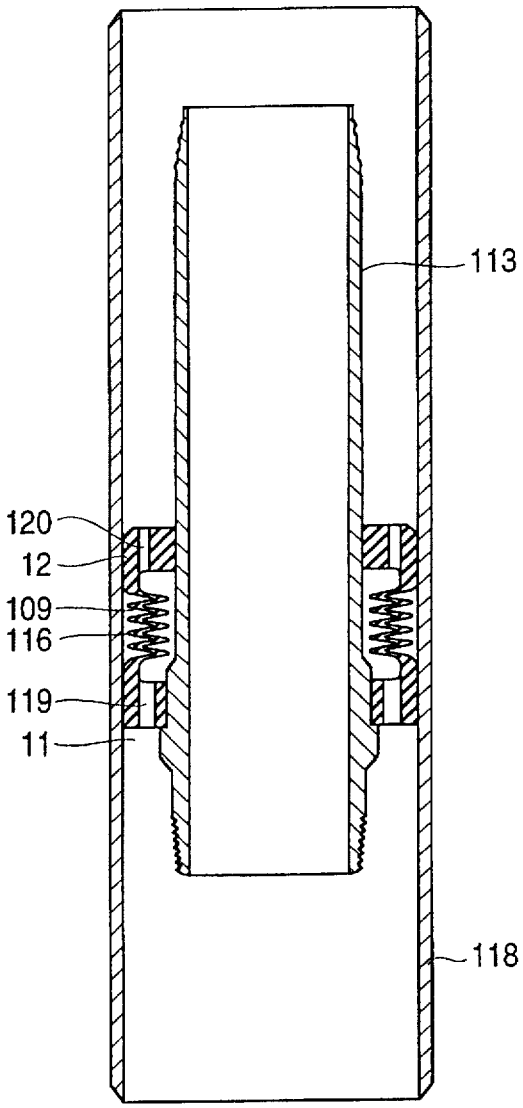
FIG. 12 is a view similar to FIG. 11 but showing the bladder during the curing process.

The bladder remains extended until pumping ceases at which time, due to the inherent elasticity of the elastomer, the bladder assumes the position shown in FIG. 12.

Slots 119 permit cement to fall away until a pressure differential is established. At this time, the upper end, 12, tends to migrate toward the lower end and the pressure differential is increased. This increased pressure differential encourages and effects a seal between the bladder 109 and the casings 113 and 118 which further restricts the reverse flow of the cement. A portion of the cement will be retained within the bladder and this cement will be forced against the casing 113 effecting a superior bond between the cement and the casing. When the pressure is relaxed the full hydrostatic head of the cement column is exerted on the bladder further compressing the bellows section 116.

Figure 13:
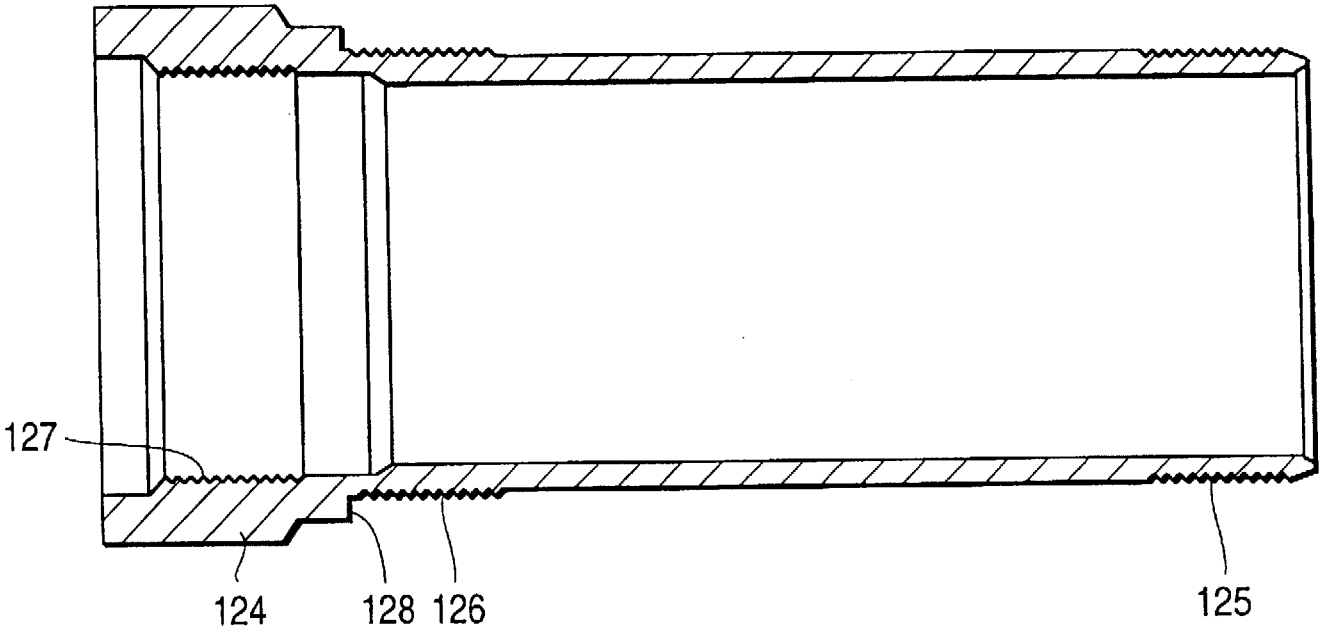
FIG. 13 is a longitudinal sectional view of a form of casing section which is preferred as the production casing section upon which the bladder is mounted.

Casing section 113 on which the bladder 109 to mounted is preferably a special short length of casing known as a pup casing or a pupsub illustrated in FIG. 13. The pup casing 113 is provided with a flange 124 at one end and an external thread 125 at the other end. An external thread 126 is also provided adjacent the flange 124 and it is with this thread that the thread on the bladder is mated. A further thread 127 is formed on the bore of the pupsub at the flange. The pupsub is installed in the production casing by means of threads 125 and 127.

In use the flange 124 would be disposed below thread 126 such that it provides a shoulder 128 which ensures that the bladder is retained on the pupsub even if the threads are stripped. Of course different techniques for securing the lower end of the bladder to the production casing section may be contemplated to fall within the scope of the invention.

Although the bladder of the Invention was primarily designed for use between the production casing and the Surface casing it is contemplated that with minor adaptation It could be used either in open hole wells (which do not have a surface casing) or below the surface casing. In both cases, the bladder would provide a seal between the production casing and the earth formation.

We claim:

1. A method of cementing a production casing in a borehole having a surface casing therein wherein cement is pumped down through the production casing and back up through an annular space between the production casing and the surface casing thereby cementing the production casing into the borehole and the surface casing, the method further comprising, prior to pumping, attaching to an external surface of a production casing section one end of a tubular expandable resilient bladder provided with axially extending slot means, installing the production casing section and bladder inside the surface casing at a predetermined location such that the one end of the bladder is a lower end, whereby on pumping of the cement the bladder expands and flows through the slot means and when pumping ceases the bladder contracts and effects an improved bond between the cement when it cures and the production casing section and the surface casing.

2. A method according to claim 1 wherein the casing section is a casing sub having an external thread mating with an internal thread in the bladder.

3. A method according to claim 2 wherein the bladder is formed generally as a tubular bellows having a flange at each end, each flange having circumferentially located axially extending through slots communicating with the interior of the bellows, the slots of one flange being considerably greater in cross-sectional area than the slots in the other flange, the internal thread on the bladder being located at the flange having the slots with the greater cross-sectional area.

4. A method according to claim 1 wherein the bladder is formed generally of a tubular bellows.

5. A method according to claim 4 wherein the bladder has a flange at each end and each flange has circumferentially located axially extending through slots communicating with the interior of the bellows, the slots of one flange being considerably greater in cross-sectional area than the slots in the other flange.

6. A method according to claim 1 wherein the bladder is formed generally as a tubular bellows having a flange at each end, each flange having circumferentially located axially extending through slots communicating with the interior of the bellows, the bladder being attached to the production casing section at one of the flanges.

7. A method according to claim 6 wherein the slots of the flange attached to the production casing are greater in cross-sectional area then the slots in the other flange.

8. A bladder for use in well completion comprising a tubular bellows made of a resilient material, the bellows having axially extending slot means communicating with the interior of the bellows, the bellows having an extended condition in which a fluid path is complete via the slot means through the interior of the bellows and a retracted condition.

9. A bladder according to claim 8 wherein the bladder has a flange at each end and each flange has circumferentially located axially extending through slots communicating with the interior of the bellows, the slots of one flange being considerably greater in cross-sectional area than the slots in the other flange.

10. A bladder according to claim 9 having an internal thread located at the flange having the slots with the greater cross-sectional area.

11. A bladder according to claim 10 in combination with a pup casing having an external thread mating with the internal thread of the bladder.

12. The combination claimed in claim 11 wherein the pup casing has an upwardly facing shoulder located downwardly of the external thread, the flange having the slots with the greater cross-sectional area abutting the shoulder.

13. A bladder according to claim 8 wherein the bladder has a flange at each end, each flange having circumferentially located axially extending through slots communicating with the interior of the bladder.

14. A bladder according to claim 13 wherein the slots of one flange are greater in cross-section area then the slots in the other flange.

15. A method of cementing a production casing in a borehole wherein cement is pumped down through the production casing and back up through an annular space between the production casing and the borehole thereby cementing the production casing into the borehole, the method further comprising, prior to pumping, attaching to an external surface of a production casing section one end of a tubular expandable resilient bladder provided with axially extending slot means, installing the production casing section and bladder inside the borehole at a predetermined location, whereby on pumping of the cement the bladder expands and flows through the slot means and when pumping ceases the bladder contracts and effects an improved bond between the cement when it cures and the production casing section and the sides of the borehole.

16. A method of cementing a production casing in a borehole having a surface casing therein wherein cement is pumped down through the production casing and back up through an annular space between the production casing and the surface casing thereby cementing the production casing into the borehole and the surface casing, the method further comprising, prior to pumping, attaching at a predetermined depth in the annular space a tubular expandable resilient bladder provided with axially extending slots, the bladder having a lower end which is fixed relative to the production casing and an upper end which is free to move relative to the production casing, whereby on pumping of the cement the bladder expands and flows through the slots and when pumping ceases the bladder contracts and effects an improved bond between the cement when it cures and the production casing and the surface casing.

* * * * *